United States Patent [19]

Bennett

[11] 4,014,472

[45] Mar. 29, 1977

[54] DISCHARGE NOZZLE STRUCTURE

[75] Inventor: Richard Nelson Bennett, Arbutus, Md.

[73] Assignee: National Instrument Company, Inc., Baltimore, Md.

[22] Filed: Aug. 18, 1975

[21] Appl. No.: 605,331

[52] U.S. Cl. ..... 239/533.1; 141/392

[51] Int. Cl.[2] ..... B05B 1/30

[58] Field of Search ..... 239/452, 453, 533, 541, 239/562; 141/392

[56] References Cited

UNITED STATES PATENTS

| | | | |
|---|---|---|---|
| 1,893,457 | 1/1933 | Tartrais | 239/453 |
| 2,035,203 | 3/1936 | Smith | 239/452 X |
| 2,592,111 | 4/1952 | Bischof | 239/533 |
| 3,285,300 | 11/1966 | Mistarz | 141/392 |

*Primary Examiner*—John J. Love

*Attorney, Agent, or Firm*—Craig & Antonelli

[57] ABSTRACT

A nozzle assembly for high-speed filling units which provides a positive closing of the nozzle by spring action to prevent dripping, and in which the spring-loaded closure member is opened by the force of the product under pressure during the discharge cycle of the filling pump.

18 Claims, 1 Drawing Figure

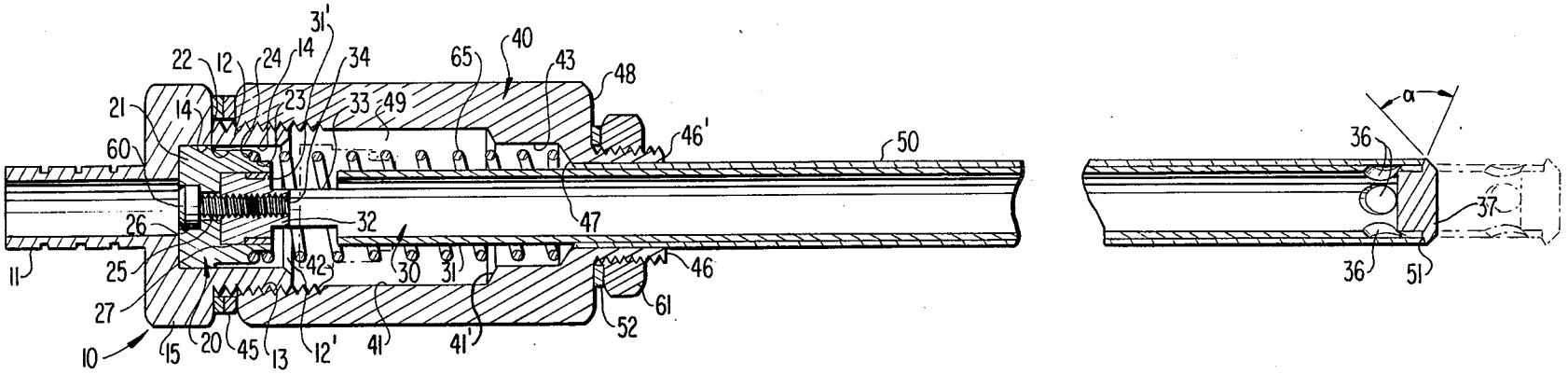
α
37
51
36
36
50
46'
46
61
52
48
47
43
40
65
41'
31
30
41
49
33
34
32
31'
14
23
42
12'
24
13
12
45
22
14
20
15
21
60
26
25
27
10
11

DISCHARGE NOZZLE STRUCTURE

The present invention relates to a valve structure, and more particularly to a nozzle structure for use in filling machines for high-speed filling of containers, bottles, vials, ampoules, etc.

Various types of filling machines are known in the art which can operate to fill small containers such as bottles with various products. These filling machines thereby operate with more or less acceptable accuracy as regards the amount of the product to be filled into the small containers. The U.S. Pat. No. 2,807,213 is representative of such prior art filling machine, capable of high-speed filling with relatively good accuracy.

The product is actually filled into the small containers through a filling or discharge nozzle connected to the end of the discharge hose. These discharge nozzles are normally lowered into the containers during the filling operation and the speed at which the filling machine is able to operate depends on the discharge cross section of the nozzle.

One of the main drawbacks of the prior art nozzle structure resides in the relatively small opening or openings through which the discharge into the small container takes place thereby seriously limiting the speed of operation of the filling machine. The nozzles used heretofore are limited in the size of their discharge orifice or orifices since excessively large discharge orifices, desirable from a point of view of speed of operation, would result in dripping due to the resulting surface tension.

Attempts have been made to solve these contradictory requirements by the use of screens in the tip of the nozzle. However, such screens are unsuitable for relatively viscous products and also readily clog due to the impurities in the product which is normally unfiltered.

On the other hand, any dripping from the discharge nozzle may not only affect the cleanliness of the container or bottle and of the filling instrument but also represents a bad waste in the product.

The present invention is concerned with the task to eliminate the aforementioned disadvantages and to provide a discharge nozzle for use with high-speed filling machines which permits an increase in the rate of flow through the discharge nozzle without danger of dripping. The underlying problems are solved according to the present invention in that a nozzle structure is provided in which the nozzle assembly produces a positive closing action, whereby the opening is assured by the force of the liquid under pressure from the filling machine on a piston assembly.

In one advantageous embodiment of the present invention, the discharge nozzle assembly consists of an elongated outer sleeve, within which an inner hollow sleeve member is slidably received. The inner sleeve or nozzle member which is of a shape complementary to the outer sleeve member is thereby provided near its outer end with discharge holes so located in relation to an end-closure valve member that the liquid on the inside of the inner sleeve member is able to flow through the discharge holes into the container to be filled when the inner sleeve member is displaced so that both the end-closure valve member and the discharge holes are located substantially outside of the outer sleeve member. The inner hollow sleeve member is thereby axially displaced into the nozzle-opening position by fluid pressure of the product on a piston slidably received within the cylinder space of a cylinder structure connected to the discharge hose. Openings are provided in the inner sleeve member near the piston end thereof to permit the flow of the liquid product from the cylinder space into the interior of the hollow inner sleeve member when the piston and therewith the inner sleeve member, secured thereto, are displaced in the axial direction by the product under pressure. A spring holds the piston and hollow inner sleeve member together with the end-closure member in the normally closed position, i.e., with the discharge holes located inside the outer sleeve member and with the end-closure member providing a positive closing action by abutment at the outer sleeve member.

In one particularly advantageous construction, the cylinder structure is formed of an upper casing member provided with an externally threaded neck portion over which is threadably secured a lower casing member which in turn is rigidly secured with an offset neck portion to the outer sleeve member.

The nozzle structure according to the present invention not only permits an increase in the filling speed by as much as 400% but also greatly increases the accuracies which could be increased surprisingly by the discharge nozzle structure of the present invention to approximately ±0.1% to ±0.5% as opposed to about ±1% using the prior art standard nozzles. Furthermore, the increase in speed and increase in accuracies are obtained with the present invention without any danger of dripping of the product from the discharge nozzle and without the need of high pressures on the part of the product to be filled.

Accordingly, it is an object of the present invention to provide a discharge nozzle for use in high-speed filling machines which avoids by simple means the aforementioned shortcomings and drawbacks encountered in the prior art.

Another object of the present invention resides in a filling nozzle for filling machines which permits a significant increase in the speed of operation of the filling machine.

A further object of the present invention resides in a filling nozzle which not only permits an increase in the speed of operation of the filling machine but also assures an increase in the filling accuracies of the machine.

Still a further object of the present invention resides in a discharge nozzle structure which is actuated by the pressure of the product to be filled, yet avoids the need of high pressures on the part of the product to reliably open and close the positive action-type nozzle structure.

Still another object of the present invention resides in a nozzle structure of the type described above which is simple in construction, easy to assemble, yet prevents with certainly any after-drip notwithstanding a significant increase in the speed of operation.

These and other objects, features and advantages of the present invention will become more apparent from the following description when taken in connection with the accompanying drawing which shows, for purposes of illustration only, one embodiment in accordance with the present invention, and wherein:

The single FIGURE is an axial longitudinal cross sectional view through one embodiment of a nozzle structure in accordance with the present invention.

Referring now to the single FIGURE of the drawing, the discharge hose (not shown) is adapted to be connected with the nipple portion 11 of an upper casing generally designated by reference numeral 10. The upper casing 10, in addition to the nipple portion 11, includes a neck portion 12 externally threaded at 13 as well as a hexagonal nut portion 15 between the nipple portion 11 and the neck portion 12. An internal bore 14 which extends from the free end of the neck portion 12 into the nut portion 15 provides a cylinder surface for a nozzle piston structure generally designated by reference numeral 20. The nozzle piston structure 20 includes a piston section 21, properly speaking, which is slidable within the cylinder surface 14. Additionally, the piston structure 20 includes a first offset portion 22, which is slightly reduced in diameter, compared to the diameter of the cylinder surface 14 and a second offset portion 23 of further reduced diametric dimension, thereby forming a spring abutment shoulder 24.

The piston structure 20 is also provided with a central hole 25, countersunk at 26 to receive a fastening screw 60 adapted to fasten the piston structure to the inner hollow sleeve member 31 as will be described more fully hereinafter. The piston structure 20 is additionally provided on its downstream side with an internal bore or recess 27 in communication with the bore 25 but of larger diametric dimension.

The internal nozzle assembly generally designated by reference numeral 30 includes a sleeve-like internal, hollow nozzle member 31 which with its inner end 31', i.e., with its left end as viewed in the drawing, is securely mounted over and fastened to an end member 32 of a configuration complementary to the internal recess 27. The end member 32 is thereby fastened to the piston structure 20 by means of the screw 60 so that the piston structure 20 and inner sleeve member 31 move in unison. Near its inner end 31', the inner sleeve-like nozzle member 31 is provided with openings 33, for example, with two diametrically cut-in openings 33, to provide a continuously open communication between the inner space of the hollow sleeve-like member 31 and the cylinder space 49. It is thus seen that the piston structure 20 and the internal nozzle assembly 30 are fixed together so as to move in unison when the piston structure is displaced by the pressure of the product to be filled against the force of spring 65, which normally holds the piston structure 20 and internal nozzle assembly 30 in the left end position as viewed in the drawing. The spring 65 thereby abuts at the spring abutment 24, on the one hand, and against an inclined surface 47 of the lower casing structure generally designated by reference numeral 40, on the other. The latter is provided with a first cylindrical surface portion 41 adjoined by way of a bevelled surface 41' by a second cylindrical surface portion 43' of approximately the same dimension as the cylindrical surface 14. Additionally, the left end of the lower casing member 40 is provided with an internal thread 42 to be threadably mounted over the external thread 13 of the upper casing member 10, possibly by the interposition of one or more washers 45, such as "Velbestos" washers.

The outer sleeve member 50 which slidably receives the inner sleeve-like nozzle member 31 is fixedly secured to the lower casing 40 by conventional means, such as by helium-arc welding. The neck portion 46 is provided with an external thread 46' for threaded engagement with a tightening nut 61 to enable assembly of the nozzle structure to the corresponding nozzle support bracket (not shown), preferably by interposition of a flat washer 52. Of course, any other suitable fastening means known as such in the art may be used to fasten the outer sleeve member 50 to the lower casing structure 40.

Discharge openings 36, for example, four in number are provided on a 45° angle near the right end of the inner sleeve-like nozzle member 31. Additionally, a plug-like end-closure member 37 is inserted into the right end of the inner sleeve-like nozzle member 31 to which it is securely fastened by conventional means. The plug-like end-closure member 37 is thereby provided with oppositely inclined end surface subtending an angle $\alpha$ therebetween which may be, for example, 20° to 40°. The outer sleeve member 50 is provided with a complementary bevelled end surface 51 so that a positive closing action of the nozzle is assured by the action of spring 65 normally holding the piston structure 20 and internal nozzle assembly 30 and therewith the end-closure member 37 in the closing position, whence a positive valving action is assured at the end of the filling cycle which prevents after-dripping.

The neck portion 12 is also provided with bevelled surfaces 12' so as to facilitate the re-entry of the piston structure 20 into the cylinder surface 12 and more specifically also to facilitate the outflow of the product under pressure into the cylinder space 49 when the piston structure 20 and internal nozzle assembly have been axially displaced toward the right as viewed in the drawing into the open position of the discharge nozzle in which the piston member has left the cylinder surface 14.

OPERATION

In operation, the product under pressure enters through the nipple portion 11 and forces the piston structure 20 and therewith the internal nozzle assembly 30 fixedly secured thereto, axially toward the right, so that the end member 37 lifts off from the sealing surface 51 of the outer sleeve member 50 and the discharge holes 36 will be displaced so as to be outside the sleeve member 50. However, initially the product under pressure only acts on the exposed surface of the piston 21 of the piston assembly 20 and cannot flow into the space 49 since the engagement between the outer surface of the piston section 21 with the internal bore surface 14 prevents such flow. The fully open position of the parts of the discharge nozzle is shown in dash and dot lines in the single FIGURE of the drawing.

As soon as the piston assembly 20 has been displaced beyond the cylinder surface 14, a communication will be established between the inside of the nipple 11 and the space 49 so that the product to be filled will now be able to flow into the cylinder space 49 and from there through the openings 33 into the inside of the inner sleeve-like nozzle member 31, to be ultimately discharged through the holes 36 into the container to be filled with the holes 36 now already in the fully open position. This continues as long as the filling pump continues to keep the product under pressure during the discharge stroke. When the pump of the filling unit passes over to its suction stroke, the spring 65 will return the piston and nozzle assembly 20, 30 into the closed position.

Thus, initially the product under pressure is confined to the piston space and only acts on the end face of the piston member 21 of the piston assembly 20 exposed to the product, while the piston assembly 20 is being displaced to open up the holes 36 since no communication exists between the piston space, defined by the end face of the piston section 21, and the space 49. However, once the piston assembly 20 has been displaced so far that the bore 14 is in communication with the space 49 and therewith with the inside of the inner sleeve 31, which in the meantime has moved to fully open holes 36, the product under pressure will flow into the space 49 and by way of the inside of the inner sleeve member 31 will be discharged through holes 36. Consequently, the nozzle structure of the present invention has only two positions, namely, a closed position and an open position, i.e. a position in which the product is closed from the space 49 and a position in which a through path exists by way of space 49, inner sleeve 31 and discharge holes 36.

One of the important features of the present invention is the fact that the opening of the positive action discharge nozzle can be achieved with relatively low pressures of the product to be filled. This is achieved by the relatively large size of the actuating area of the piston 21 which assures a relatively large actuating force notwithstanding the relatively low pressure at which the product to be filled is supplied by the filling pump, since $$F = p \times A$$

where

F = actuating force p = pressure per unit area

A = area of piston acted upon by product under pressure.

No satisfactory results could be achieved in the absence of this relatively large area of the piston end surface acted upon by the product to be filled, which must be larger than the cross sectional area of the outer sleeve, taken at right angle to the axis thereof. Since the piston 21, the bore of the outer sleeve member 50 and the outer surface of the inner sleeve member 31 are normally circular in a cross section taken at right angle to the axes thereof, this means that the diameter of piston 21 is larger than the diameter of the outer surface of the inner sleeve member 31 and of the bore of the outer sleeve member 50. The proper dimension of piston 21 in relation to the other parts 31, 50 for satisfactory operation can be readily determined empirically and must be the larger the greater the viscosity.

As mentioned before, the filling speeds can be increased by the use of a nozzle in accordance with the present invention by as much as 400%. Furthermore, the nozzle in accordance with the present invention will be able to handle most varied products, and viscosities such as viscosities from alcohol to No. 50 oil. All that is necessary is that the products are free-flowing. Furthermore, the accuracies obtainable with the nozzle in accordance with the present invention will be improved considerably by a factor of 2 to 10 compared to the accuracies obtainable with the prior nozzles.

While I have shown and described one embodiment in accordance with the present invention, it is understood that the same is not limited thereto but is susceptible of numerous changes and modifications as known to those skilled in the art, and I therefore do not wish to be limited to the details shown and described herein but intend to cover all such changes and modifications as are encompassed by the scope of the appended claims.

I claim:

1. A nozzle structure for use with high-speed filling machines operable to fill containers with a product discharged under pressure, which comprises first means defining a cylinder section of a first diametric dimension adjoined by a space section of larger diametric dimensions and including further means for admitting a product under pressure into the space section by way of the cylinder section, an outer sleeve means securely connected near one end thereof to said first means and extending therefrom towards its other end in a direction opposite to the cylinder section, second means including a piston section of complementary dimensions to and slidable within said cylinder section and hollow inner sleeve means fixedly connected at one end thereof with said piston section and in continuously open communication with said space section, said hollow inner sleeve means being provided with discharge hole means near its other end, said second means having a first position in which said discharge hole means are closed off by said outer sleeve means and the space section is substantially closed off with respect to the further means for admitting the product under pressure so that the latter acts substantially exclusively on the exposed piston surface of the piston section, and a second position in which, after displacement of the second means by the product under pressure, the discharge hole means are free of the outer sleeve means and the further means for admitting the product under pressure is in communication with said space section so as to enable the discharge of the product from the further means by way of said space section, the hollow inner sleeve means and the discharge hole means, and spring means urging said second means into the first position thereof.

2. A nozzle structure according to claim 1, wherein said space section, the inside of the hollow inner sleeve means and the discharge hole means are in continuous communication with each other and define an approximately constant volume during movement of the second means until the discharge hole means are opened.

3. A nozzle structure according to claim 2, in which only two spaces exist separated from one another in the structure for the product when the second means is in said first position, and said only two spaces are in communication with each other to form a through-flow path for the product when the second means is in the second position.

4. A nozzle structure according to claim 3, wherein said separated spaces consist, on the one hand, of the space in said further means and eventually in the adjoining cylinder section until the piston section has left the cylinder section, and on the other hand, of said space section in said first means, of the inside of said hollow sleeve means and of the discharge hole means.

5. A nozzle structure according to claim 4, characterized in that a closure means is securely connected to the inner sleeve means slidable within the outer sleeve means, the spring means normally holding the second means and therewith the inner sleeve means and the closure means in a retracted position thereof in which the closure means abuts against the outer sleeve means, the piston section being slidably received within the cylinder section, and the further means forming a space on the inside thereof, into which the product under pressure is able to flow to displace the second means by the pressure force of the product against the spring force, and the inner end of the inner sleeve means being provided with openings to establish a communication between said space section and the interior of the inner sleeve means.

6. A nozzle structure according to claim 5, characterized in that the first means consists of a first casing structure providing the cylinder section, and a second casing structure threadably secured over a threaded portion of the first casing structure.

7. A nozzle assembly according to claim 6, characterized in that the second casing structure includes a neck portion fixed to the outer sleeve means, and the first casing structure is in one piece with said further means for admitting the product under pressure.

8. A nozzle structure according to claim 1, in which only two spaces exist separated from one another in the structure for the product when the second means is in said first position, and said only two spaces are in communication with each other to form a through-flow path for the product when the second means is in the second position.

9. A nozzle structure according to claim 8, wherein said separated spaces consist, on the one hand, of the space in said further means and eventually in the adjoining cylinder section until the piston section has left the cylinder section, and on the other hand, of said space section in said first means, of the inside of said hollow sleeve means and of the discharge hole means.

10. A nozzle structure according to claim 1, characterized in that a closure means is securely connected to the inner sleeve means slidable within the outer sleeve means, the spring means normally holding the second means and therewith the inner sleeve means and the closure means in a retracted position thereof in which the closure means abuts against the outer sleeve means, the piston section being slidably received within the cylinder section, and the further means forming a space on the inside thereof, into which the product under pressure is able to flow to displace the second means by the pressure force of the product against the spring force, and the inner end of the inner sleeve means being provided with openings to establish a communication between said space section and the interior of the inner sleeve means.

11. A nozzle structure according to claim 1, characterized in that the first means consists of a first casing structure providing the cylinder section, and a second casing structure threadably secured over a threaded portion of the first casing structure.

12. A nozzle assembly according to claim 11, characterized in that the second casing structure includes a neck portion fixed to the outer sleeve means, and the first casing structure is in one piece with said further means for admitting the product under pressure.

13. A nozzle structure for use with high-speed filling machines operable to fill containers with a product discharged under pressure, which comprises first means defining a cylinder section of a first diametric dimension adjoined by a space section of larger diametric dimension and including further means for admitting a product under pressure into the space section by way of the cylinder section, an outer sleeve-like means fixed near one end thereof to said first means and extending therefrom toward its other end in a direction opposite to the cylinder section, second means including a piston section of complementary dimensions to and slidable within said cylinder section and an inner reciprocable member of smaller outer dimensions that the inner dimensions of said outer sleeve-like means to enable reciprocation of said inner member within said outer sleeve-like means, said inner member extending substantially coaxially through said outer sleeve-like means, being fixedly connected at one end thereof with said piston and defining at least in part a discharge path for the product to be discharged which is in continuously open communication with said section, said inner member being provided with a closure means as its other end adapted to engage with said outer sleeve-like means to thereby close off the other end of the nozzle structure, discharge means for said flow path near the other end of said inner member, said second means having a first position in which said discharge means are closed off by engagement of said closure means with said outer sleeve-like means and in which the space section is substantially closed off with respect to the further means for admitting the product under pressure so that the latter acts substantially exclusively on the exposed piston surface of the piston section, and a second position in which, after displacemnt of the second means by the product under pressure, the closure means moves out of engagement with said outer sleeve-like means and therewith the discharge means are opened up and in which the further means for admitting the product under pressure is in communication with said space section so as to enable the discharge of the product from the further means by way of said space section, said discharge path and said discharge means, and spring means normally urging said second means into the first position thereof.

14. A nozzle structure according to claim 13, wherein said space section, said discharge path defined at least in part by the inner member and the discharge means are in continuous communication with each other and define an approximately constant volume during the movement of the second means until the discharge means are opened by disengagement of said closure means from said outer sleeve-like means.

15. A nozzle structure according to claim 14, in which only two spaces exist for the product which are separated from one another in the structure when the second means is in said first position, and said only two spaces are in communication with each other to form a through-flow path for the product when the second means is in the second position.

16. A nozzle structure according to claim 15, wherein said separated spaces consist, on the one hand, of the space in said further means and eventually in the adjoining cylinder section until the piston section has left the cylinder section, and on the other hand, of said space section in said first means, of said discharge path defined at least in part by said inner member and of the discharge means.

17. A nozzle structure according to claim 16, characterized in that the closure means is securely connected to the inner member slidable within and substantially coaxial with the outer sleeve-like means, the spring means normally holding the second means and therewith the inner member and the closure means in a retracted position thereof in which the closure means abuts against the outer sleeve-like means, the piston section being slidably received within the cylinder section, and the further means forming a space on the inside thereof, into which the product under pressure is able to flow to displace the second means by the pressure force of the product against the spring force.

18. A nozzle structure according to claim 17, characterized in that the first means consists of a first casing structure providing the cylinder section, and of a second casing structure further secured to said first casing structure.

* * * * *